US007146665B1

(12) United States Patent
Moorin

(10) Patent No.: US 7,146,665 B1
(45) Date of Patent: Dec. 12, 2006

(54) INFLATABLE, DISPOSABLE PILLOW WITH COMFORT FEATURES

(76) Inventor: Steve H. Moorin, 1299 S. Ocean Blvd., Suite T-3, Boca Raton, FL (US) 33432

( * ) Notice: Subject to any disclaimer, the term of this patent is extended or adjusted under 35 U.S.C. 154(b) by 60 days.

(21) Appl. No.: 10/860,826

(22) Filed: Jun. 5, 2004

(51) Int. Cl.
*A47G 9/10* (2006.01)

(52) U.S. Cl. ..... 5/644; 5/639; 5/915; 5/932

(58) Field of Classification Search ..... 5/644, 5/654, 655.3, 706, 932, 639, 915
See application file for complete search history.

(56) References Cited

U.S. PATENT DOCUMENTS

| | | | | |
|---|---|---|---|---|
| 673,872 | A | 5/1901 | Hillern-Flinsch | |
| 2,728,926 | A * | 1/1956 | Emery | 5/644 |
| 3,235,892 | A * | 2/1966 | Emery | 441/130 |
| 3,312,987 | A * | 4/1967 | Emery | 5/644 |
| 3,416,169 | A * | 12/1968 | Emery | 5/644 |
| 3,638,253 | A * | 2/1972 | Stumpf | 5/644 |
| 3,705,645 | A * | 12/1972 | Konen | 5/644 |
| 3,765,412 | A | 10/1973 | Ommaya et al. | |
| 3,778,852 | A * | 12/1973 | Penn et al. | 5/422 |
| 3,840,916 | A * | 10/1974 | Jennings | 5/655 |
| 3,855,631 | A | 12/1974 | Ettinger | |
| 4,099,773 | A * | 7/1978 | Chang | 297/270.5 |
| 4,133,064 | A * | 1/1979 | Petrusek | 5/644 |
| 4,161,794 | A * | 7/1979 | Darnfors | 5/644 |
| 4,272,856 | A * | 6/1981 | Wegener et al. | 5/81.1 T |
| 4,274,161 | A | 6/1981 | Littler | |
| 4,285,081 | A | 8/1981 | Price | |
| 4,345,347 | A | 8/1982 | Kantor | |
| 4,501,023 | A | 2/1985 | Bilberry | |
| 4,517,690 | A * | 5/1985 | Wegener | 5/81.1 R |
| 4,528,704 | A * | 7/1985 | Wegener et al. | 5/81.1 R |
| 4,679,262 | A * | 7/1987 | Davis et al. | 5/644 |
| 4,686,719 | A * | 8/1987 | Johnson et al. | 5/81.1 R |
| 4,872,229 | A * | 10/1989 | Brady | 5/710 |
| 5,060,661 | A | 10/1991 | Howard | |
| 5,067,189 | A * | 11/1991 | Weedling et al. | 5/81.1 R |
| D322,380 | S | 12/1991 | El-Asir | |
| 5,133,084 | A | 7/1992 | Martin | |
| 5,308,163 | A * | 5/1994 | Abe | 383/44 |
| 5,313,670 | A | 5/1994 | Archer, III | |
| 5,330,255 | A | 7/1994 | Stawicki | |
| 5,333,336 | A * | 8/1994 | Langsam | 5/654 |
| 5,344,437 | A * | 9/1994 | Pistay | 607/109 |
| 5,402,535 | A | 4/1995 | Green | |
| 5,403,266 | A | 4/1995 | Bragg et al. | |
| 5,421,760 | A | 6/1995 | Blaga | |

(Continued)

FOREIGN PATENT DOCUMENTS

| | | |
|---|---|---|
| GB | 2198341 | 6/1988 |

*Primary Examiner*—Robert G. Santos
(74) *Attorney, Agent, or Firm*—Allen D. Hertz

(57) ABSTRACT

An inflatable pillow that is of low cost, thus disposable. The inflatable pillow taught is one fabricated from very low cost materials and of a very low cost fabrication process resulting in a disposable inflatable pillow. The present invention teaches a user comforted seam, the seam either placing the seam allowance within the gas enclosure or finished such as by rolling. The pillow is fabricated by an assembly process of bonding a section of the perimeter seal, inverting the inflatable pillow, then bonding the remaining seams. A sealable valve is assembled prior to the bonding of the final seams. Artwork can be added for a number of desires including advertising.

20 Claims, 14 Drawing Sheets

U.S. PATENT DOCUMENTS 5,471,690 A 12/1995 McNeil
RE35,299 E * 7/1996 Weedling et al. ..... 5/81.1 T
5,598,593 A * 2/1997 Wolfe ..... 5/710
5,752,927 A 5/1998 Rogachevsky
5,779,512 A 7/1998 Rupert
5,830,780 A * 11/1998 Dennison et al. ..... 428/68
6,019,122 A * 2/2000 Chen ..... 137/223
6,047,425 A * 4/2000 Khazaal ..... 5/644
6,050,965 A 4/2000 Pillai
6,170,513 B1 * 1/2001 Lo ..... 137/223
6,175,978 B1 1/2001 Nizzi et al.
6,206,475 B1 * 3/2001 Tai ..... 297/452.41
6,289,538 B1 9/2001 Fidge
6,301,714 B1 10/2001 Son
6,418,579 B1 * 7/2002 Perez et al. ..... 5/713
6,447,468 B1 9/2002 Hankins et al.
6,519,796 B1 * 2/2003 Sloot ..... 5/636
6,568,011 B1 * 5/2003 Fisher et al. ..... 5/706
6,671,910 B1 * 1/2004 Hsu et al. ..... 5/710
6,934,989 B1 * 8/2005 Ledvina et al. ..... 5/644
2001/0040401 A1 11/2001 Lin
2002/0004948 A1 1/2002 Son
2002/0078506 A1 * 6/2002 Sloot ..... 5/644
2002/0083528 A1 * 7/2002 Fisher et al. ..... 5/706
2002/0125758 A1 9/2002 Duncan
2003/0101516 A1 * 6/2003 Hsu et al. ..... 5/710
2004/0064892 A1 * 4/2004 Ledvina et al. ..... 5/644
2005/0229316 A1 * 10/2005 Liao ..... 5/639

* cited by examiner

INFLATABLE, DISPOSABLE PILLOW WITH COMFORT FEATURES

FIELD OF THE INVENTION

This invention relates in general to a disposable pillow and the respective method of manufacture, more specifically an inflatable, disposable pillow with features for comfort.

BACKGROUND OF THE INVENTION

The present invention is generally related to a disposable pillow with features specifically designed for comfort.

Pillows are desired for a broad number of applications, including but not limited to airline rides, train rides, car rides, medical applications, and the like. In commercial applications, it would be desirable for a low cost, disposable solution.

It is desirable that the pillows be sanitary.

Airline industry is currently utilizing small polyester filled pillows with disposable pillow covers. The polyester filled pillows dictate volume storage. Volume/space is a critical component in airlines and other industries. Disposable pillow covers require labor for readiness. There is a cost associated with the disposable pillow covers.

Pre-filled pillows are not easily storable.

Pre-filled pillows are not easily shippable.

Pre-filled pillows are not easily vendible.

El-Asir (UK Patent appl GB 2198341) teaches a "C" shaped inflatable pillow comprising a closure member that utilizes a seam allowance positioned external to the gas envelope. El-Asir requires the inclusion of the external seam allowance for the fabrication process taught.

Concerns of sanitary means for inflatable pillows must be considered.

Current inflatable pillows position a seam allowance external to the pillow. The seam allowance then becomes an irritant to the user. This irritation is aggravated when the shape of the pillow positions the seam allowance directly contacting the user, such as a "C" shaped pillow. Valve designs and common assembly processes would direct the designer away from changing this flaw.

Conventional pillows are either "C" shaped or rectangular. The "C" shaped pillows are all designed such where the rear is equal to or larger than the side sections.

Conventional pillows fail to consider specific accupoints.

Novel material has been recently introduced, the material comprising a polyethylene smooth side and a fibrous woven softer side.

Standard manufacturing processes of inflatable plastic objects results in the excess material of the seam remaining on the outside of the inflatable object. This would be consistent with an inflatable pillow.

What is desired is a method to manufacture and apparatus of a low cost, disposable and comfortable disposable pillow.

SUMMARY OF THE INVENTION

The present invention addresses the deficiencies in consumer and travel pillow technology.

A first aspect to the present invention is a disposable pillow.

A second aspect to the present invention is an inflatable pillow.

A third aspect to the present invention is an inflation member.

A fourth aspect to the present invention is a self-sealing inflatable member.

A fifth aspect to the present invention is an inflatable pillow with a seam allowance towards an inside of the inflatable pillow.

A sixth aspect to the present invention is a pillow of a gas impermeable material comprising a polyethylene smooth side (inner core side) and a fibrous woven softer side (finished side).

A seventh aspect to the present invention utilizes an assembly process of thermally bonding the seams.

An eighth aspect of the present invention utilizes an assembly process to thermally bonding the seams of the polyethylene smooth side and a fibrous woven softer side.

A ninth aspect to the present invention utilizes the step of bonding with the fibrous woven softer sides contacting each other.

A tenth aspect to the present invention is a design of a "C" shaped pillow with a rear section that has a smaller cross section compared to each of the sides.

An eleventh aspect to the present invention is a "C" shaped pillow with a coupling member positioned between each of the ends of the "C" shaped pillow allowing the user to couple the pillow around the user's neck.

A twelfth aspect to the present invention is a trimmed seam allowance near corners and curves to assist in inverting the inflatable pillow.

A thirteenth aspect to the present invention is the utilization of any of the following bonding techniques:

a) Thermal Bonding, b) Dispensed adhesive, c) Contact cement, d) Pressure sensitive adhesive, e) Thermally set, pressure sensitive adhesive, f) bead and channel (such as a zip lock™ closure), and g) automated application of any of the above bonding process.

A fourteenth aspect to the present invention is a method of manufacture utilizing a shaped bonding tool.

A fifteenth aspect to the present invention is a method of manufacture utilizing a steel rule die for trimming/shaping of the inflatable pillow.

A sixteenth aspect to the present invention is the utilization of a bonding wheel.

A seventeenth aspect to the present invention is the utilization of a programmable bonding tool, wherein the programmable bonding tool is automated to create a bond following a predetermined pattern.

An eighteenth aspect to the present invention is the utilization of a cutting tool, wherein the programmable cutting tool is automated to trim the inflatable pillow in a predetermined pattern.

A nineteenth aspect to the present invention is the use of a combination bonding and cutting tool.

A twentieth aspect to the present invention is the step of automating the combination bonding and cutting tool.

A twenty-first aspect to the present invention is the inclusion of a pressure relief valve. This would be desirable for applications with changes in pressure such as air travel.

A twenty-second aspect to the present invention is an alternate embodiment is an inflatable pillow comprising a seam allowance on the exterior of the gas envelope and rolling the seam allowance.

A twenty-third aspect to the present invention is the inclusion of artwork on the inflatable pillow.

A twenty-third aspect to the present invention is wherein the artwork on the inflatable pillow is a logo of the respective party (i.e. an airline company for an airline use).

A twenty-forth aspect to the present invention is wherein the artwork on the inflatable pillow is an advertisement or logo of an advertised company.

A twenty-fifth aspect to the present invention is the inclusion of a vibrating device at least one of capable of being coupled to and coupled to a section of the inflatable pillow.

A twenty-sixth aspect to the present invention is the inclusion of a vibrating device at least one of capable of being coupled to and coupled to an accupoint section of the inflatable pillow.

A twenty-seventh aspect to the present invention is the inclusion of a pocket within the inflatable pillow, the pocket designed to contain a removable vibrating device.

A twenty-eighth aspect to the present invention is the inclusion of a pocket within the accupoint section of the inflatable pillow, the pocket designed to contain a removable vibrating device.

A twenty-ninth aspect to the present invention includes a power source for the vibrating device.

A thirtieth aspect to the present invention includes a power source for the vibrating device, whereby the power source is of a stored power source such as a battery.

A thirty-first aspect to the present invention includes a power source for the vibrating device, whereby the power source is remote such as being provided by a power cable between the vibrating device and a power plug located in an airline seat.

A thirty-second aspect to the present invention includes an amplitude adjusting circuit for the vibrating device.

A thirty-third aspect to the present invention includes a frequency adjusting circuit for the vibrating device.

BRIEF DESCRIPTION OF THE DRAWINGS

For the purpose of initially illustrating the invention, there is shown in the flow diagram, an embodiment that is presently preferred. It should be understood, however, that the present invention is not limited to the specific instrumentalities and methods disclosed. It can be recognized that the flow diagram represents a method and the associated apparatuses required to make the method in which persons skilled in the art may make various flow and interface diagrams from therein. In the drawings.

It should be understood that the order or process steps may deviate from each of the flow diagrams provided herein, while maintaining the spirit and intent of the present invention.

DETAILED DESCRIPTION OF THE DRAWINGS

Figure 1:
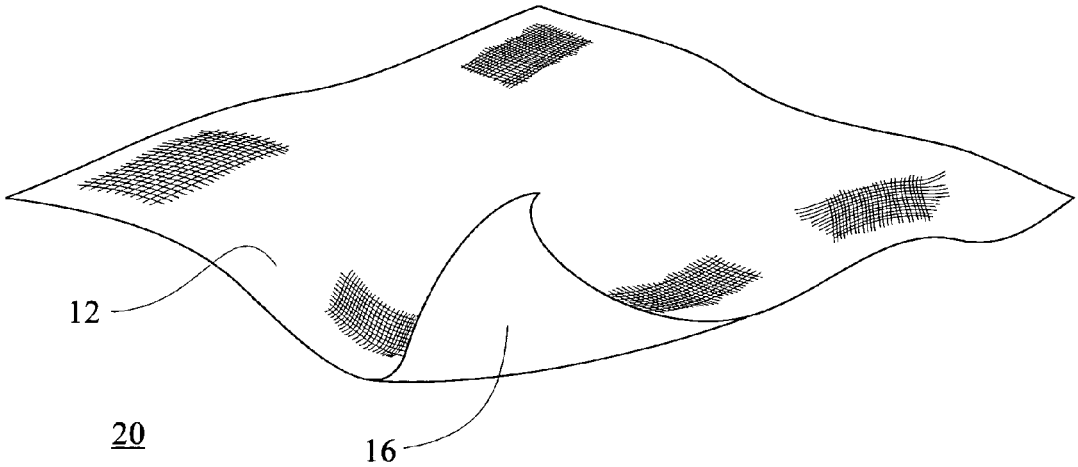
PRIOR ART FIG. 1
FIG. 1 is an isometric illustration of a recently developed polyethylene material.

FIG. 1 illustrates an isometric reference of a recently developed single side textured polyethylene 20 comprising a fibrous, soft woven side(s) of polyethylene 12 and a smooth side of polyethylene 16. The material is such that either side can be thermally bonded. The fibrous, soft woven side(s) of polyethylene 12 would be the desirable contact side for the user. The smooth side of polyethylene 16 is generally considered the proper side for bonding two pieces of single side textured polyethylene 20 by those skilled in the art.

Figure 2:
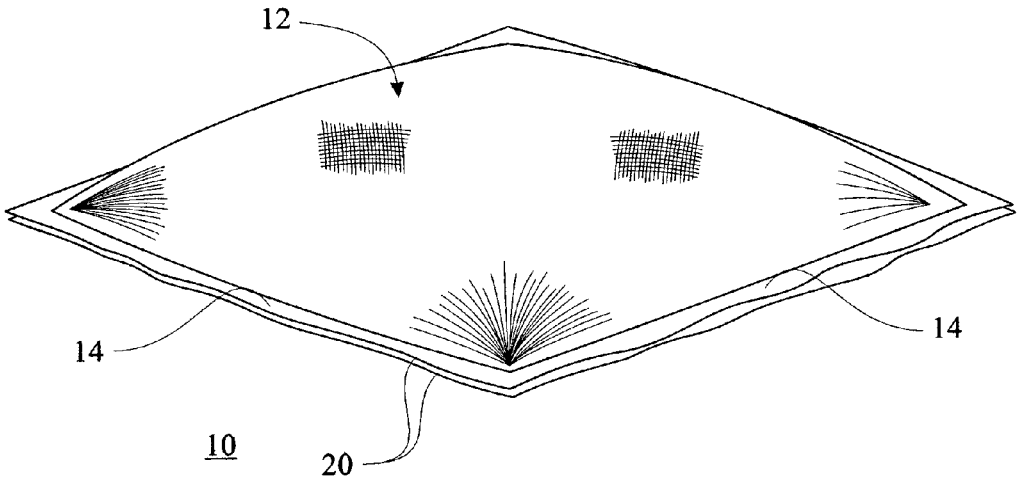
PRIOR ART FIG. 2
FIG. 2 is an isometric illustration of a known inflatable pillow.

FIG. 2 illustrates a detailed isometric view of a known inflatable pillow 10. The known inflatable pillow 10 is manufactured using two pieces of the single side textured polyethylene 20 by thermally bonding the two pieces of the single side textured polyethylene 20 along thermal bonded seam(s) 22. The known inflatable pillow 10 is configured with a fibrous, soft woven side(s) of polyethylene 12 towards the outside providing comfort to the user. The known inflatable pillow 10 illustrated can comprise any of a variety of fill and seal valves. The pillow illustrated is rectangular, whereby it is known that pillows are in other shapes including "C" shapes to wrap around the user's neck. All of the known "C" shaped pillows have all sides equal in size (diameter when inflated) or where the back section is larger in size than the two sides. This places the user's head in an awkward position, tending to push the users head forward, particularly when sitting upright (traveling). The seam allowance of these pillows is towards the exterior of the pillow. The seam allowance is uncomfortable when contacting the user. This should be considered, particularly for pillows whereby the seam is positioned in a manner in which increases the probability of the seam allowance contacting the user.

Figure 3:
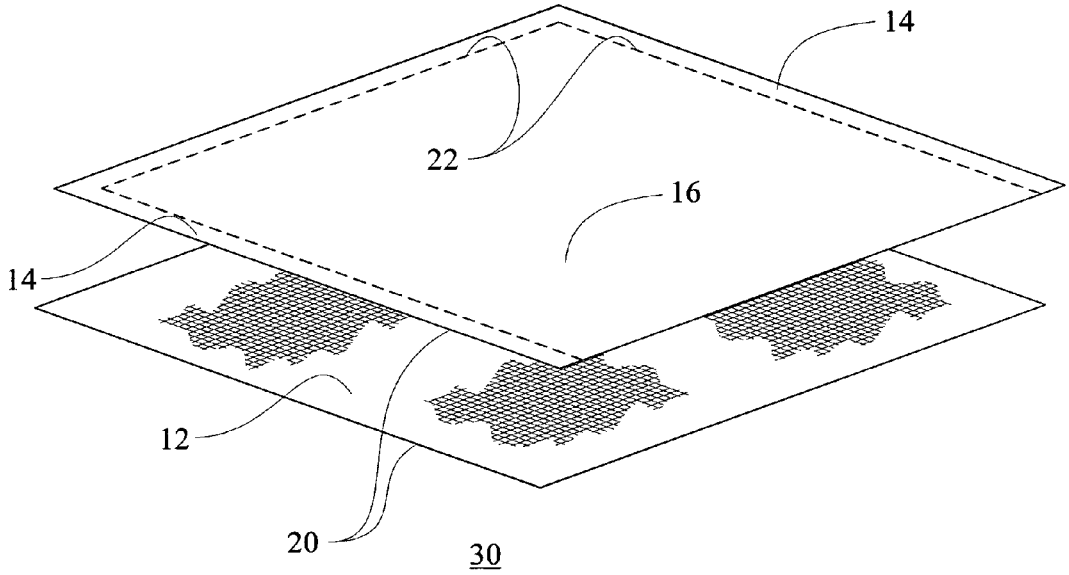
FIG. 3 is an isometric illustration representing a first step of assembling present invention.

FIG. 3 illustrates a first step of fabricating a comfortable, inflatable, disposable pillow 30, wherein two sheets of single side textured polyethylene 20 are positioned with the fibrous, soft woven side(s) of polyethylene 12 contacting each other. The two sheets of single side textured polyethylene 20 are thermally bonding along a thermal bonded seam(s) 22 leaving at least one section at least partially unbonded allowing the comfortable, inflatable, disposable pillow 30 to be inverted after bonding. Alternatively a single sheet can be used and folded placing the fibrous, soft woven side(s) of polyethylene 12 contacting each other. It can be understood that although the figure illustrates a rectangular shape, alternate shapes can be utilized. Other shapes will be illustrated within the specification. It can be understood that although the present invention describes the application of a fibrous, soft woven side(s) of polyethylene 12, the present invention should not be limited to the requirement of such, as a significant element of the teachings is the application of inverting said comfortable, inflatable, disposable pillow 30 resulting in a seam allowance 14 being positioned internal to a gas envelope (understood within FIG. 2 but not illustrated in FIG. 3). One example would be the alternate application of a satin sided material, wherein the satin side replaces said fibrous, soft woven side(s) of polyethylene 12.

Figure 4:
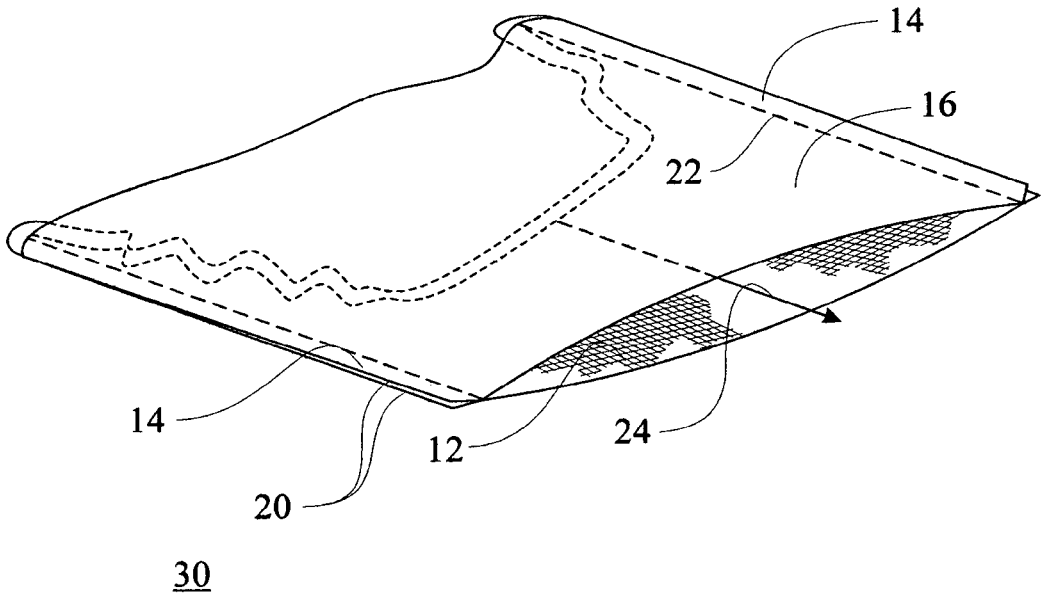
FIG. 4 is an isometric illustration representing a second step of assembling present invention.

FIG. 4 illustrates a second step of fabrication process for fabricating the comfortable, inflatable, disposable pillow 30. Prior to inverting the comfortable, inflatable, disposable pillow 30, it would be desirable to trim the corners of the seam allowance 14 and create slits in areas proximate any curves of the seam allowance 14. The second step would be to invert the known inflatable pillow 10 by a motion to turn inside out 24. The step of inverting the comfortable, inflatable, disposable pillow 30 positions the fibrous, soft woven side(s) of polyethylene 12 as the exterior of the comfortable, inflatable, disposable pillow 30. The motion to turn inside out 24 can be accomplished by either pulling the material through the unbonded section or by pushing the material through the unbonded section.

Figure 5:
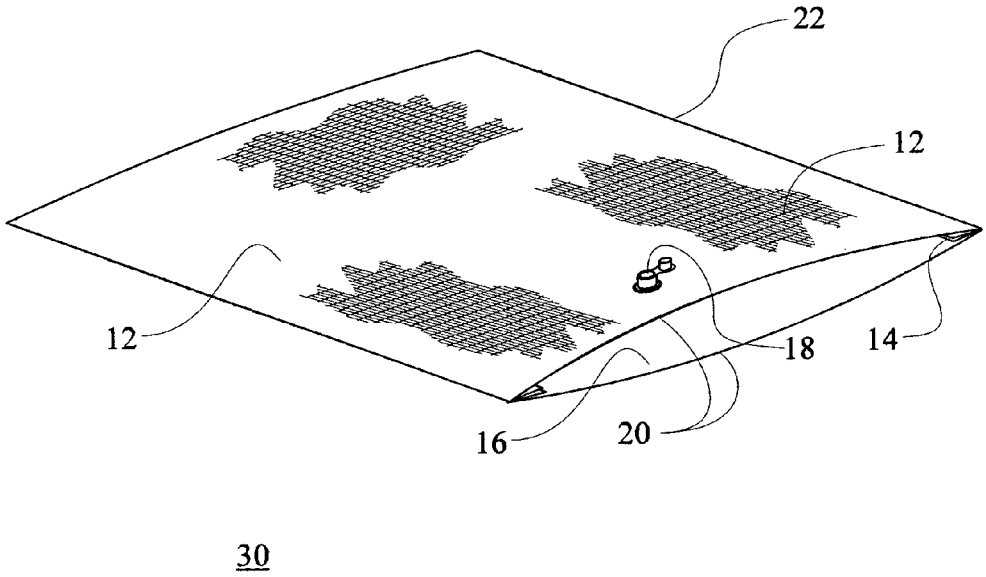
FIG. 5 is an isometric illustration representing a third step of assembling present invention.

FIG. 5 illustrates a third step of the fabrication process for fabricating the comfortable, inflatable, disposable pillow 30. The third step would be assembling the filler valve 18 to one of the sheets of single side textured polyethylene 20. Illustrated is a commonly known pull out valve similar to that of one found on a beach ball or pool toy. It can be recognized that any filler valve 18 can be utilized such as a bead and channel (such as a zip lock™ closure). An alternate filler valve 18 will be shown further in the specification. It can be recognized that the filler valve 18 can be assembled to the sheet of single side textured polyethylene 20 prior to the first step described herein within distancing from the spirit and intent of the present invention.

Figure 6:
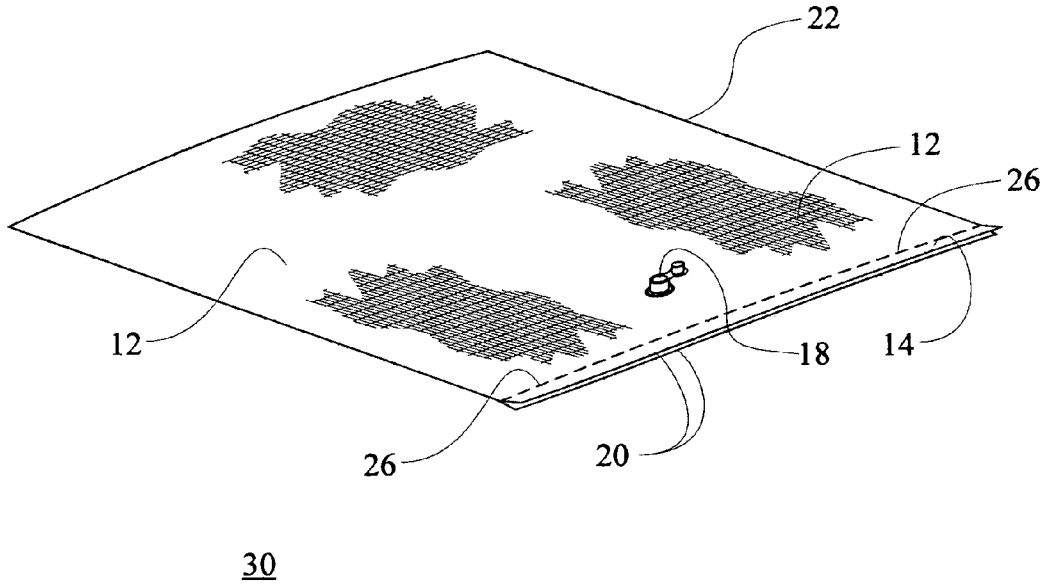
FIG. 6 is an isometric illustration representing a fourth step of assembling present invention.

FIG. 6 illustrates a fourth step of the fabrication process for fabricating the comfortable, inflatable, disposable pillow 30. The forth step would create a secondary seal 26 to provide an airtight seal between the two sheets of single side textured polyethylene 20 resulting in a gas containing envelope. Should the comfortable, inflatable, disposable pillow 30 be shaped, it would be desirable to position the secondary seal 26 away from the area designed to contact the user.

Figure 7:
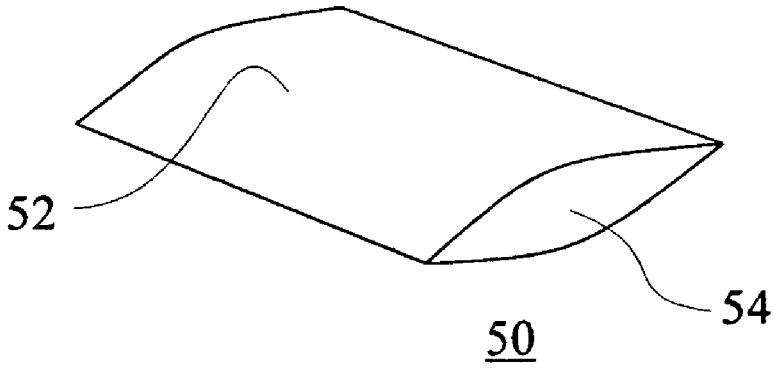
FIG. 7 is an isometric illustration representing an alternate valve configuration.
Figure 7:
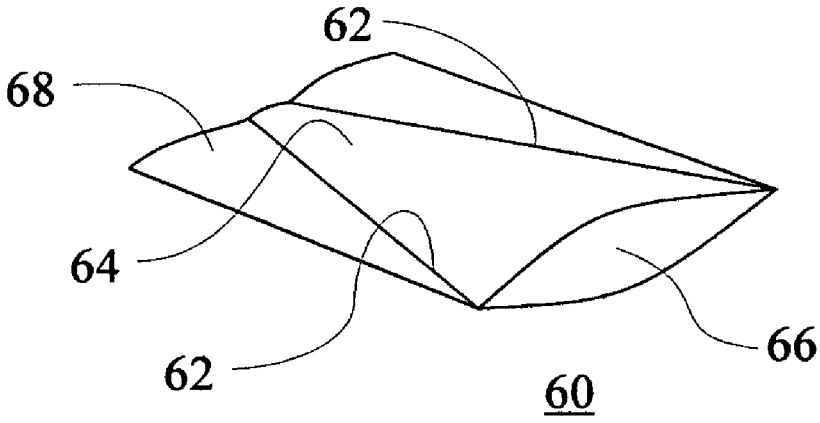

FIG. 7 illustrates a self sealing valve raw material 50 as provided in a raw state and a finished self sealing valve 60 as provided in a finished state. The self sealing valve raw material 50 is received as a flexible plastic tube material 52 with a flexible plastic tube hollow interior section 54. The flexible plastic tube material 52 would be extruded for the lowest cost possible. The flexible plastic tube material 52 is converted to the finished self sealing valve 60 by thermally bonding two self sealing valve seam(s) 62 into the flexible plastic tube material 52. The two self sealing valve seam(s) 62 divide the flexible plastic tube material 52 into two sections: a self sealing valve functioning section 64 and a self sealing valve seam allowance 68. The self sealing valve functioning section 64 provides for a self sealing valve hollow interior section 66 which is used to fill and empty the comfortable, inflatable, disposable pillow 30. A hollow tube (not shown) is inserted into the self sealing valve hollow interior section 66 and air is transferred through the finished self sealing valve 60. When finished, the hollow tube is removed and the air pressure inside the enclosure applies pressure to the exterior of the finished self sealing valve 60 forcing the finished self sealing valve 60 to seal.

Figure 8:
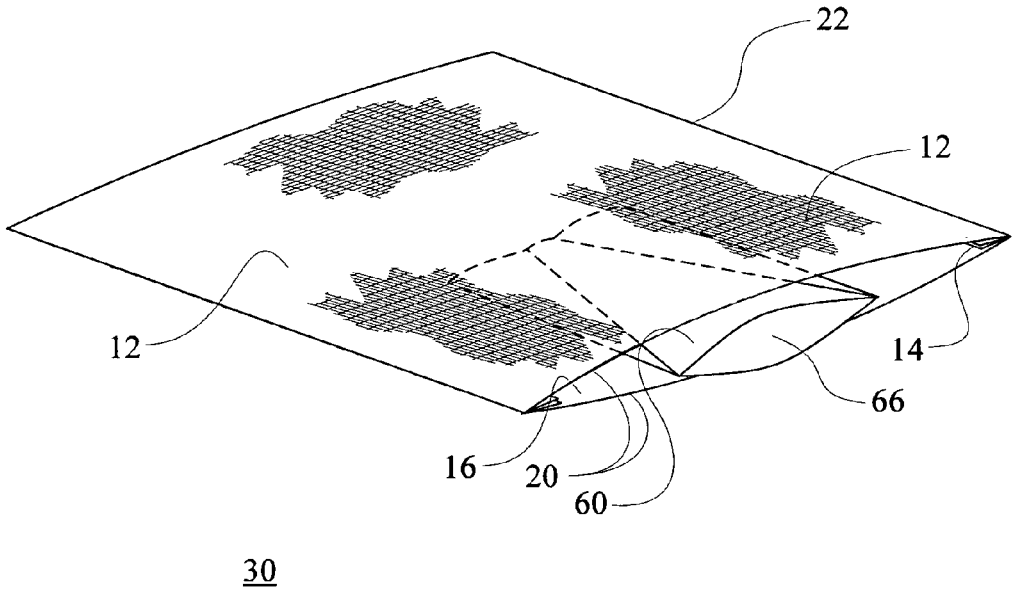
FIG. 8 is an isometric illustration representing an alternate third step of assembling present invention.

FIG. 8 illustrates an alternate third step, describing the installation of the finished self sealing valve 60. The finished self sealing valve 60 would be inserted between the two sheets of single side textured polyethylene 20 along the unbonded section. A thermally non-conductive material (not shown) would be positioned within the self sealing valve hollow interior section 66 maintaining that the finished self sealing valve 60 would not be sealed during the bonding process.

Figure 9:
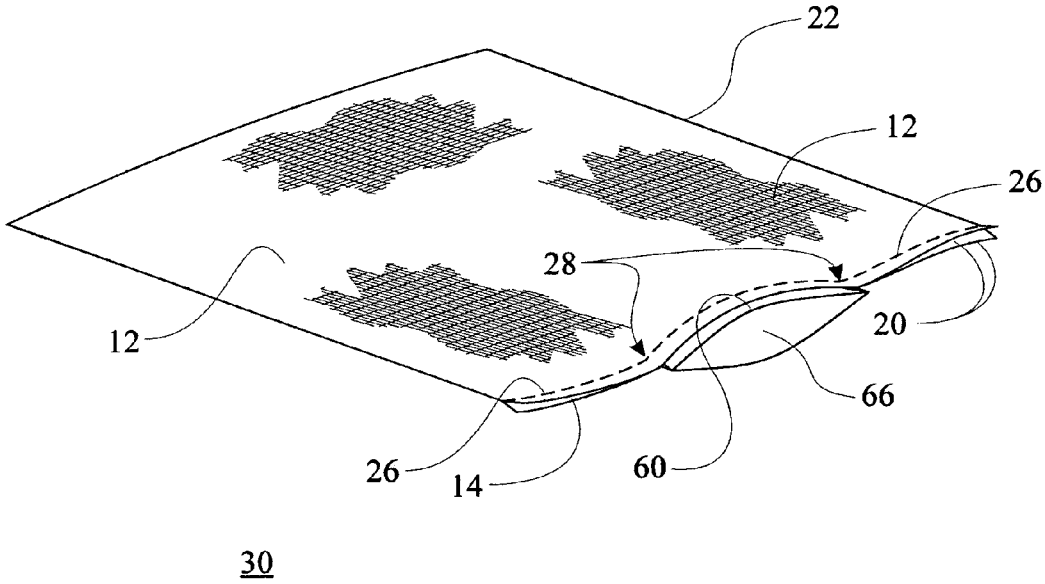
FIG. 9 is an isometric illustration representing an alternate fourth step of assembling present invention.

FIG. 9 illustrates an alternate fourth step, describing the final sealing of the comfortable, inflatable, disposable pillow 30. The single side textured polyethylene 20 would be bonded to the finished self sealing valve 60 as well as sealing the two layers of single side textured polyethylene 20 with the creation of the secondary seal 26. The thermally non-conductive material would be removed from within the self sealing valve hollow interior section 66 and a final tacking bond would be created as a valve assurance seal 28.

It can be recognized that the steps taught herein can be automated for low cost and high throughput assembly processes. Although thermal bonding is taught, other types of gas tight seams can be utilized, such as glue, adhesive, tape, pressure sensitive adhesive, and the like.

Figure 10:
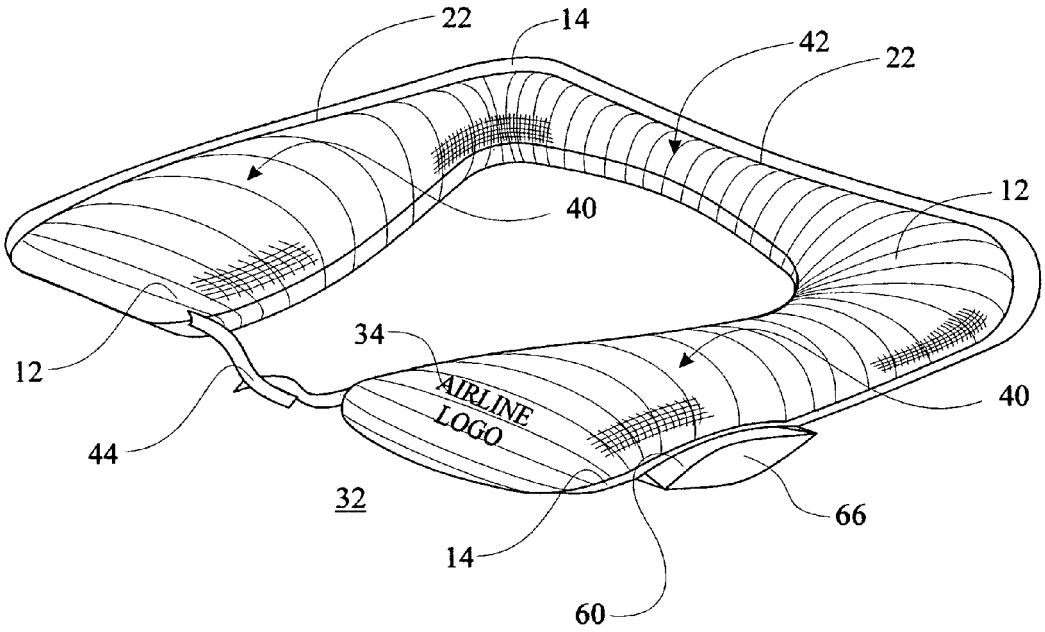
FIG. 10 is an isometric illustration representing a formed version of the present invention comprising additional features.

FIG. 10 illustrates an isometric view representing a formed comfortable, inflatable, disposable pillow 32. The formed comfortable, inflatable, disposable pillow 32 includes a finished self sealing valve 60 positioned on the side of the formed comfortable, inflatable, disposable pillow 32. The illustration teaches several novel features, including formed pillow sides 40 that are larger than a formed pillow rear 42. The illustration is such to emphasis the difference, whereby the degree of difference in the actual reduction to practice may be less than illustrated herein. The layout of the sheets of single side textured polyethylene 20 are cut where they are much wider for the formed pillow sides 40 and narrow near the formed pillow rear 42 area. This results in a larger diameter for the formed pillow sides 40 compared to the formed pillow rear 42. This provides support to the user when sitting more upright. Further supporting the novelty is a formed pillow closure 44 which couples the two formed pillow rear 42 about the user's neck, thus maintaining the 32 about the user. The formed pillow closure 44 can comprise, but it not limited to the group of temporary closures comprising: Velcro, elastic, ribbon, snap fastener, button and buttonhole, drawstring and bead, belt and clasp, hook and eye, and a button and loop fastener. The illustration reiterates the teaching of the seam allowance 14 being at least partially within the envelope (interior) of the inflatable chamber of the comfortable, inflatable, disposable pillow 30. The illustration teaches the placement of the seam allowance 14 being at least partially within the envelope (interior) of the inflatable chamber of the comfortable, inflatable, disposable pillow 30 along the portion which contacts the user (the inside of the "C" shaped form). The illustration furthers the invention with the inclusion of artwork 34. The artwork 34 can be for ownership, corporate billboarding, advertising, and the like. Advertisements can be applied as a means to return the costs of the inflatable, disposable pillow.

Figure 11:
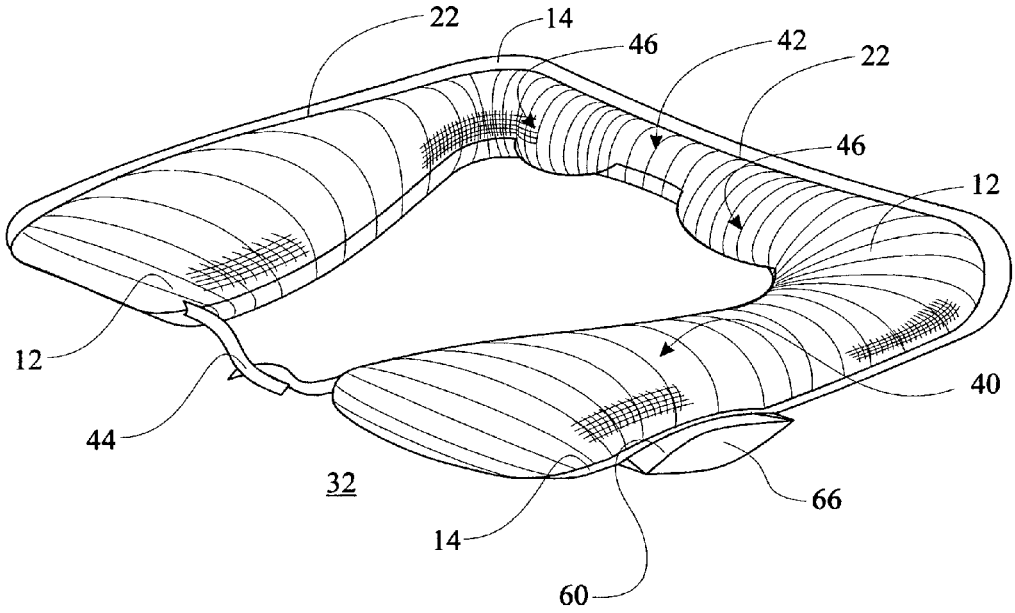
FIG. 11 is an isometric illustration of a formed pillow further comprising accupoints.

FIG. 11 is an isometric illustration of a formed comfortable, inflatable, disposable pillow 32 further comprising an accupoint location(s) 46. Accupoints are both sides of center of the occipital ridge. The accupoint location(s) 46 is a protrusion from the formed contour of the comfortable, inflatable, disposable pillow 30. The accupoint location(s) 46 would be positioned such to apply pressure to desired locations on the user's body such as accupoints. The inclusion of accupoints in conjunction with the taught feature of inverting the bonded sides of the inflatable pillow further enhances the sale-ability of the present invention. The inclusion of the accupoint location(s) 46 in the known inflatable pillow 10 positions the seam where the seam would be the point of contact to the user, whereas when combined with positioning the seam allowance 14 on the inside of the formed comfortable, inflatable, disposable pillow 32, the combined solution provides the most comfort to the user.

Figure 12:
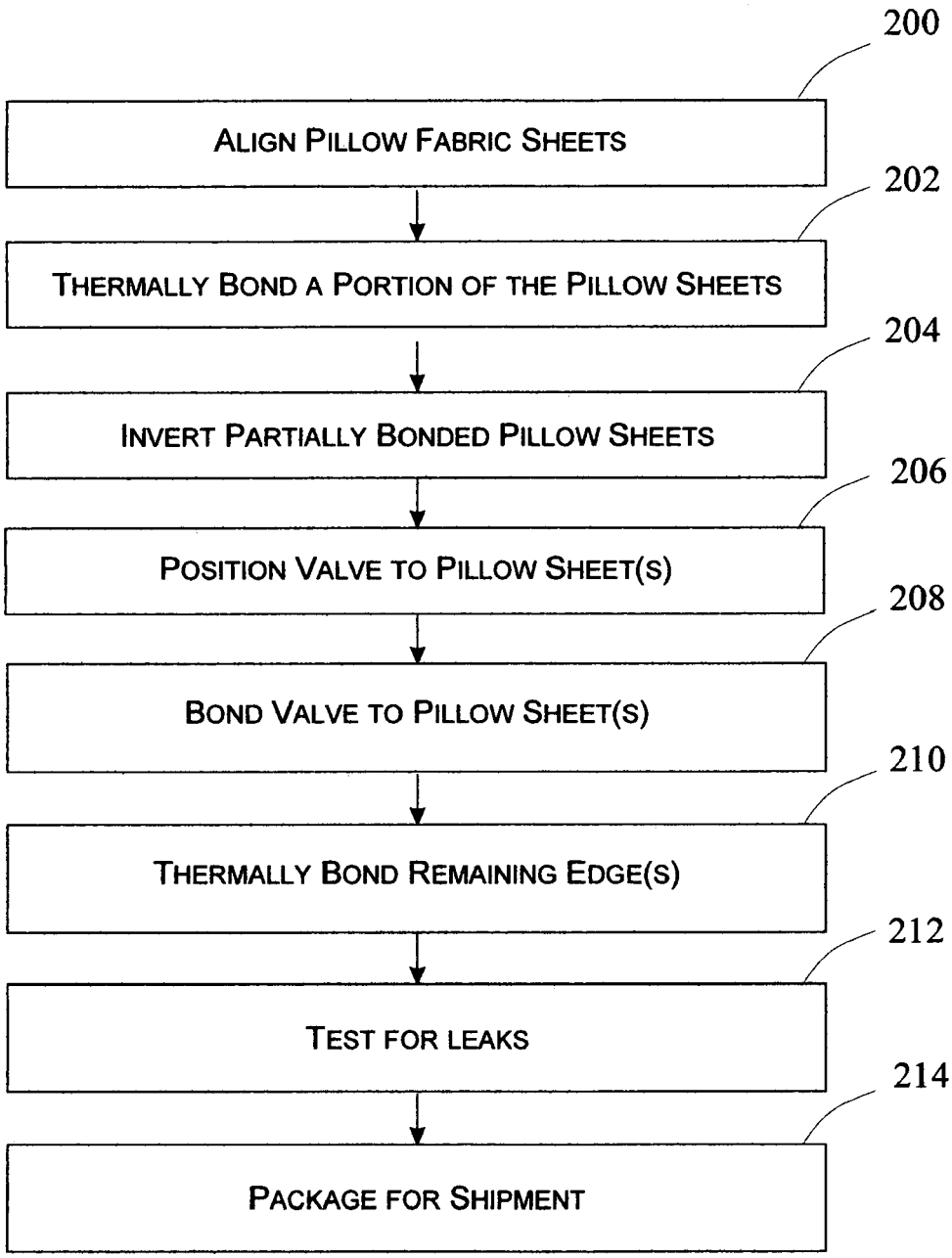
FIG. 12 is a flow diagram illustrating the steps of manufacture of the preferred embodiment.

FIG. 12 is a flowchart diagram illustrating the steps of fabricating the comfortable, inflatable, disposable pillow 30. A first fabrication step 200 is from the group of alignment processes comprising:

a) one of a single sheet of single side textured polyethylene 20 is folded, b) two sheets of single side textured polyethylene 20 are positioned with the sides desired to result as the exterior of the comfortable, inflatable, disposable pillow 30 contacting each other, and c) multiple sheets of single side textured polyethylene 20 are positioned with at least a portion of the sides desired to result as the exterior of the comfortable, inflatable, disposable pillow 30 contacting each other.

A second fabrication step 202 is to thermally bond a portion of the perimeter of the comfortable, inflatable, disposable pillow 30, leaving an opening sufficient to invert the partially completed comfortable, inflatable, disposable pillow 30. Although the inventor primarily directs the present disclosure towards a thermal bonding process, the inventor recognizes the present invention can be accomplished with alternate methods of bonding materials to create a gas tight seam. Such alternate methods include adhesive, double sided adhesive tape, bonding agent, bead and seal (such as a zip lock™ closure), pressure sensitive adhesive, and the like.

A third fabrication step 204 is to trim the seam allowance 14 at least near corners and add slits near curves and invert the partially completed comfortable, inflatable, disposable pillow 30. The trimming process removes any bulk near the corners and slits allow curves to invert without any additional tension. This would be accomplished by positioning the bonded section of the comfortable, inflatable, disposable pillow 30 through the unbonded section of the comfortable, inflatable, disposable pillow 30.

A fourth fabrication step 206 is to position at least one filler valve 18 proximate the single side textured polyethylene 20 of the comfortable, inflatable, disposable pillow 30.

A fifth fabrication step 208 is to bond the at least one filler valve 18 to the single side textured polyethylene 20. It is recognized that the fourth fabrication step 206 and the fifth fabrication step 208 can be accomplished at any point in the process prior to the final bonding step.

A sixth fabrication step 210 is to thermally bond the remaining unbonded section(s) of the comfortable, inflatable, disposable pillow 30 completing a gas tight enclosure.

A seventh fabrication step 212 is to inflate the comfortable, inflatable, disposable pillow 30 and inspect for leaks. This step would be optional, but desired for quality control.

An eighth fabrication step 214 is to package the comfortable, inflatable, disposable pillow 30 for shipment. This can be accomplished in many known means, including but not limited to individual packaging for sanitary reasons/vending distribution, stacked in boxes, bulk packaged in predetermined quantities, and the like.

It is recognized that the above taught steps can be automated to reduce fabrication costs as well as increase through put.

Figure 13:
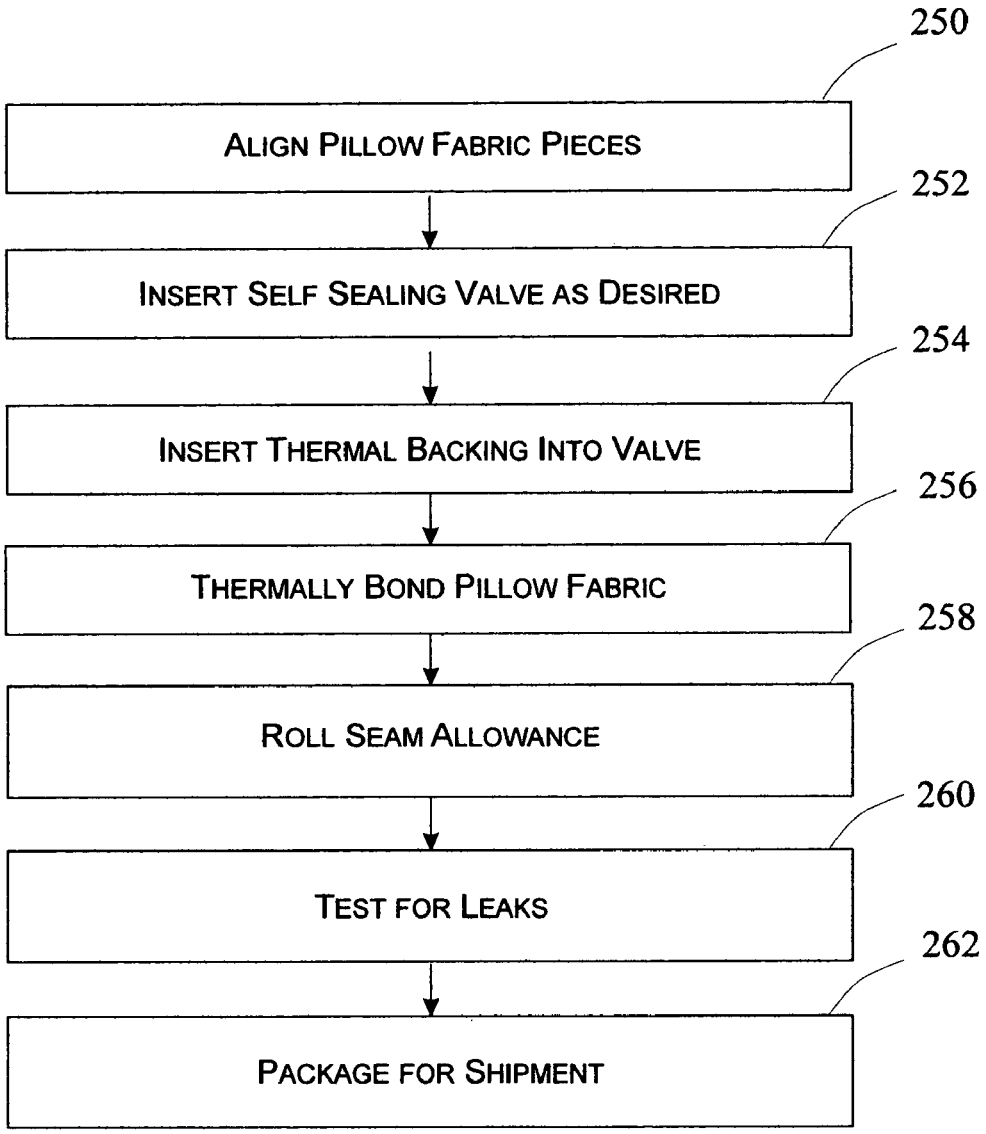
FIG. 13 is a flow diagram illustrating the steps of manufacture of an alternate embodiment.

FIG. 13 is a flowchart diagram illustrating the steps of fabricating the formed comfortable, inflatable, disposable pillow 32. A first fabrication step 250 is from the group of alignment processes comprising:

a) one of a single sheet of single side textured polyethylene 20 is folded, b) two sheets of single side textured polyethylene 20 are positioned with the sides desired to result as the exterior of the comfortable, inflatable, disposable pillow 30 contacting each other, c) multiple sheets of single side textured polyethylene 20 are positioned with at least a portion of the sides desired to result as the exterior of the comfortable, inflatable, disposable pillow 30 contacting each other, and d) any of the above wherein the sides of the single side textured polyethylene 20 desired to be towards the interior contacting each other.

A second fabrication step 252 is to position at least one finished self sealing valve 60 proximate the single side textured polyethylene 20 of the comfortable, inflatable, disposable pillow 30.

A third fabrication step 254 is to insert a thermally insulated material into the finished self sealing valve 60.

A fourth fabrication step 256 is to thermally bond the perimeter of the formed comfortable, inflatable, disposable pillow 32. Should the manufacturing process prefer to invert the assembly process would comprise a, b or c of the first fabrication step 250 and incorporate the steps taught in the flowchart respective to fabricating comfortable, inflatable, disposable pillow 30. Should the manufacturing process prefer to utilize a rolled edge, the assembly process would comprise d of the first fabrication step 250. The fourth fabrication step 250 would comprise the step of bonding the perimeter of the formed comfortable, inflatable, disposable pillow 32.

A fifth fabrication step 258 is to roll the seam allowance 14 positioned external to the inflatable envelope of the formed comfortable, inflatable, disposable pillow 32.

A sixth fabrication step 260 is to inflate the formed comfortable, inflatable, disposable pillow 32 and inspect for leaks. This step would be optional, but desired for quality control.

A seventh fabrication step 262 is to package the formed comfortable, inflatable, disposable pillow 32 for shipment. This can be accomplished in many known means, including but not limited to individual packaging for sanitary reasons/vending distribution, stacked in boxes, bulk packaged in predetermined quantities, and the like.

It is recognized that the above-taught steps can be automated to reduce fabrication costs as well as increase through put.

Figure 14:
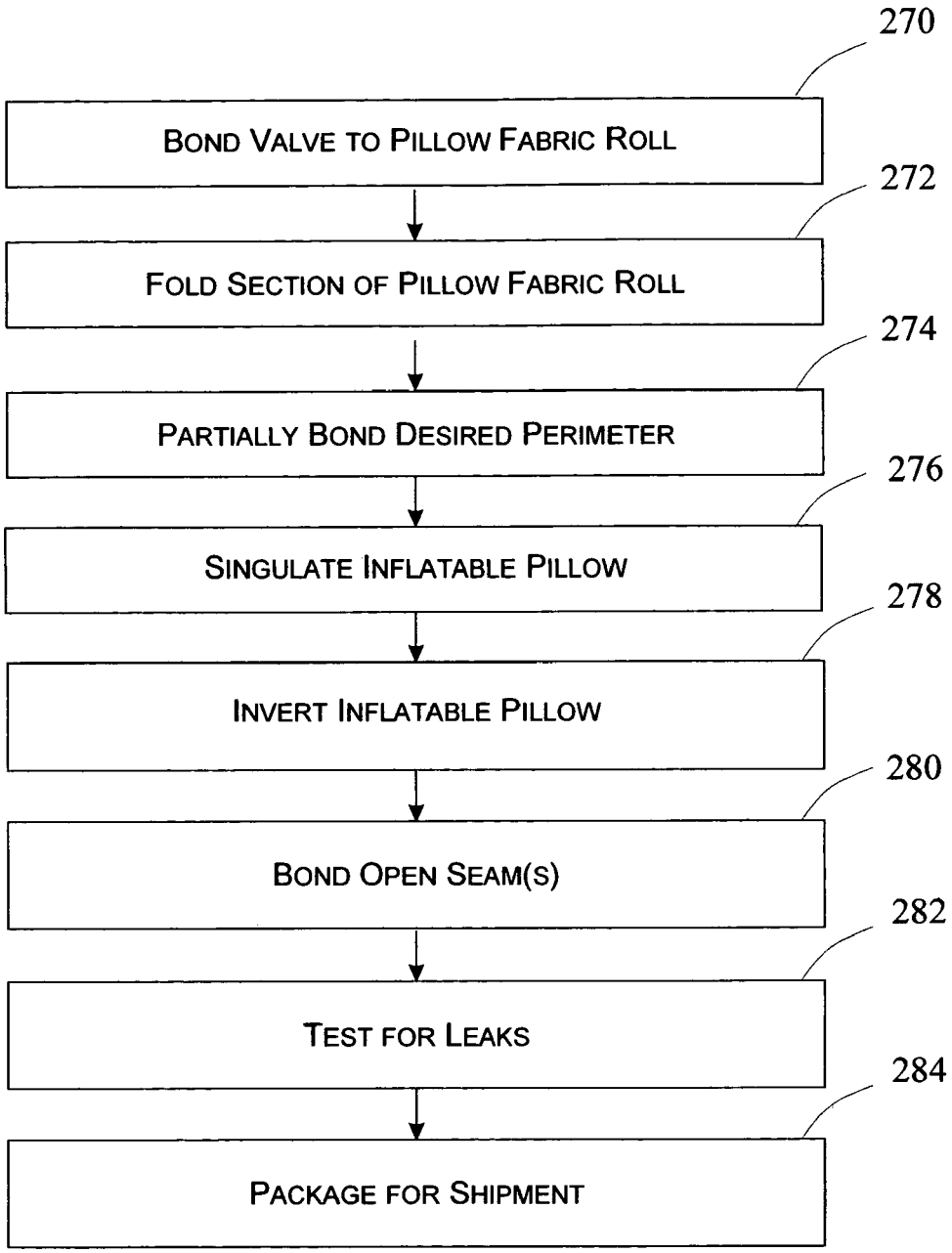
FIG. 14 is a flow diagram illustrating the automated steps of manufacture the present invention.

FIG. 14 is a flowchart diagram illustrating the steps of an automated fabrication process respective to the present invention. A first automated fabrication step 270 is to present a roll of single side textured polyethylene 20. The roll of single side textured polyethylene 20 would be positioned on an assembly line in a manner to feed the automated assembly equipment. A filler valve 18 is bonded to the single side textured polyethylene 20.

A second automated fabrication step 272 is to advance the single side textured polyethylene 20 into the automated equipment, fold the single side textured polyethylene 20 and in a third automated fabrication step 274 to bond the desired shape. Alternately, two rolls of single side textured polyethylene 20 can be presented and the two sides can be bonded in the desired shape. One means of bonding the desired shape would be to present a bonding anvil in the desired shape. A second means of bonding the desired shape would be to guide a bonding wheel along a predetermined path. A third means of bonding the desired shape would be to dispense a bonding agent along a predetermined path. Although several methods are directly taught, it can be recognized that there are many alternate methods of providing an automated bonding process.

A forth automated fabrication step 276 is to singulate the partially assembled comfortable, inflatable, disposable pillow 30.

A fifth automated fabrication step 278 is to invert the partially assembled comfortable, inflatable, disposable pillow 30.

A sixth automated fabrication step 280 is to bond any remaining open seam(s).

A seventh automated fabrication step 282 is to inflate the comfortable, inflatable, disposable pillow 30 and inspect for leaks. This step would be optional, but desired for quality control.

An eighth automated fabrication step 284 is to package the comfortable, inflatable, disposable pillow 30 for shipment. This can be accomplished in many known means, including but not limited to individual packaging for sanitary reasons/vending distribution, stacked in boxes, bulk packaged in predetermined quantities, and the like.

Taught herein is an inflatable pillow. The inflatable pillow taught is one fabricated from very low cost materials and of a very low cost fabrication process resulting in a disposable inflatable pillow. The present invention teaches a user-comforted seam.

It should be recognized that there are many options regarding how and where to place the various interfaces and the variations should not limit the spirit or intent of the present invention.

I claim:

1. An inflatable pillow, the pillow comprising: an upper gas impervious sheet, a lower gas impervious sheet, an inflatable pillow at least partially fabricated by creating a gas impervious bond between said upper gas impervious sheet and said lower gas impervious sheet and utilizing a self-sealing valve for filling said inflatable pillow; said gas impervious bond creating a gas capturing enclosure providing a shape of the inflatable pillow and accessible via said sealable valve, wherein said gas impervious bond creates a seam allowance, wherein at least a portion of said seam allowance is positioned within said gas capturing enclosure, at least one accupoint protrusion, wherein said accupoint protrusion is located proximate an area respective to at least one side of the occipital ridge and situated along said gas impervious bond and between opposing ends of a substantially contoured portion of said gas impervious bond, and wherein said self-sealing valve is located alone a section of seam allowance external to said gas capturing enclosure.

2. The inflatable pillow of claim 1, the at least one gas impervious shoat is a polyethylene material comprising a smooth plastic side and a fibrous woven softer side.

3. The inflatable pillow of claim 2 wherein said fibrous woven softer side of said polyethylene material is positioned to contact the user.

4. The inflatable pillow of claim 1, wherein said inflatable pillow further comprising a seam allowance wherein at least a portion of the seam allowance proximate anticipated contact points with a user is positioned within said gas capturing enclosure, said seam allowance further comprising at least one of:

a) trimmed proximate a corner of the gas capturing enclosure, and b) slits proximate a curved section of the seam allowance of the gas capturing enclosure.

5. The inflatable pillow of claim 1, the sealable valve is a self-sealing design.

6. The inflatable pillow of claim 1, the sealable valve is at least one of:

a) bead and channel b) pop out with flip insert seal c) pop out with flip insert seal uni-directional flow valve.

7. The inflatable pillow of claim 1, said shape of said inflatable pillow comprising a shape from the shape group consisting of:

a) a square, b) a rectangle,

C) "C" shaped, d) Kidney shaped, e) "L" shaped, f) Tubular, g) Oval, h) and i) Circular.

8. The inflatable pillow of claim 1, wherein said inflatable pillow further comprising a seam allowance wherein at least a portion of said seam allowance proximate anticipated contact points with a user is positioned within said gas capturing enclosure.

9. The inflatable pillow of claim 1, the inflatable pillow further comprising artwork on the inflatable pillow, wherein said artwork is at least one of a company logo and an advertisement.

10. An inflatable pillow, the pillow comprising:

an upper gas impervious sheet, a lower gas impervious sheet, an inflatable pillow at least partially fabricated by creating a gas impervious bond between said an upper gas impervious sheet and said lower gas impervious sheet and utilizing a self-sealing valve for filling;

said self-sealing valve comprising:

an upper self-sealing valve section bonded to said upper gas impervious sheet via a gas impervious bond;

a lower self-sealing valve section bonded to said lower gas impervious sheet via a gas impervious bond; and a gas entrance valve opening in said self-sealing valve proximate an edge of each impervious sheet;

a gas exit valve opening in said self-sealing valve opposing said edge of each impervious sheet;

wherein self-sealing valve is formed by a taper and said gas entrance valve opening is larger than said gas exit valve opening;

a gas impervious bond to create a gas capturing enclosure providing a shape of the inflatable pillow and is accessible via said self-sealing valve wherein said gas impervious bona creates a seam allowance, wherein at least a portion of said seam allowance is positioned within said gas capturing enclosure, and wherein said self-sealing valve is located alone a section of wherein said seam allowance is external to said gas capturing enclosure.

11. The inflatable pillow of claim 10, wherein said upper gas impervious sheet comprises a fibrous soft woven side, wherein said inflatable pillow is fabricated with said fibrous soft woven side positioned on the contact side of said inflatable pillow.

12. The inflatable pillow of claim 10, wherein said lower gas impervious sheet comprises a fibrous soft woven side, wherein said inflatable pillow is fabricated with said fibrous soft woven side positioned on the contact side of said inflatable pillow.

13. The inflatable pillow of claim 10 said shape of said inflatable pillow being a shape from the shape group consisting of:

j) a square,
k) a rectangle,
l) "C" shaped,
m) Kidney shaped,
n) "L" shaped,
o) Tubular,
p) Oval,
q) and
r) Circular.

14. The inflatable pillow of claim 10, said shape of said inflatable pillow further comprising at least one accupoint protrusion, wherein said accupoint protrusion is located proximate an area respective to at least one side of the occipital ridge.

15. The inflatable pillow of claim 10, the inflatable pillow further comprising artwork on the inflatable pillow, wherein said artwork is at least one of a company logo and an advertisement.

16. An inflatable pillow, the pillow comprising:

an upper gas impervious sheet, a lower gas impervious sheet, an inflatable pillow at least partially fabricated by creating a gas impervious bond between said an upper gas impervious sheet and said lower gas impervious sheet, a self-sealing valve for filling said inflatable pillow located along a section of said gas impervious bond;

at least one accupoint protrusion, wherein said accupoint protrusion is located proximate an area respective to at least one side of the occipital ridge and situated along one of said gas impervious sheets and between opposing ends of a substantially contoured portion of one of said gas impervious sheets, and at least one of a vibrating device and a vibrating device pocket coupled to said inflatable pillow, wherein said vibrating device pocket is designed to contain a removable vibrating device and wherein said vibrating device is configured to transmit vibrations through said at least one accupoint protrusion.

17. The inflatable pillow of claim 16, said shape of said inflatable pillow further comprising at least one protrusion for applying focused pressure to a specific point on the user, wherein said at least one of said vibrating device and said vibrating device pocket is positioned proximate said at least one protrusion.

18. The inflatable pillow of claim 16, the inflatable pillow further comprising artwork on the inflatable pillow, wherein said artwork is at least one of a company logo and an advertisement.

19. The inflatable pillow of claim 16, wherein at least one of said upper gas impervious sheet and said lower gas impervious sheet comprises a fibrous soft woven side, wherein said inflatable pillow is fabricated with said fibrous soft woven side positioned on the contact side of said inflatable pillow.

20. The inflatable pillow of claim 16, wherein said self-sealing valve comprising:

an upper self-sealing valve section bonded to said upper gas impervious sheet via a gas impervious bond;

a lower self-sealing valve section bonded to said lower gas Impervious sheet via a gas impervious bond; and a gas entrance valve opening in said se self-sealing valve proximate an edge of each impervious sheet; and a gas exit valve opening in said seal self-sealing able valve opposing said edge of each impervious sheet, wherein self-sealing valve is formed by a taper and said gas entrance valve opening is larger than said gas exit valve opening.

* * * * *